US005543812A

United States Patent [19]

Blanche, IV et al.

[11] Patent Number: 5,543,812

[45] Date of Patent: Aug. 6, 1996

[54] ACTIVE DEFLECTION COMPENSATOR

[75] Inventors: John G. Blanche, IV, Fullerton; Felix T. Sasso, Los Angeles, both of Calif.

[73] Assignee: Hughes Aircraft Company, Los Angeles, Calif.

[21] Appl. No.: 268,892

[22] Filed: Jun. 30, 1994

[51] Int. Cl.[6] ..... H01Q 1/22

[52] U.S. Cl. ..... 343/894; 343/760

[58] Field of Search ..... 343/894, 757, 343/890, 761, DIG. 1, 772, 760; H01Q 1/12, 1/14, 1/16, 1/18, 1/20, 1/22

[56] References Cited

U.S. PATENT DOCUMENTS 4,656,484 4/1987 Brown et al. ..... 343/761
5,151,710 9/1992 de Place ..... 343/890

*Primary Examiner*—Michael C. Wimer
*Attorney, Agent, or Firm*—Leonard A. Alkov; Wanda K. Denson-Low

[57] ABSTRACT

An active deflection compensator for use with an antenna system that comprises a linear scanner ridge that projects into a waveguide cavity coupled to an antenna array. Linear actuators are coupled to the linear ridge at opposite ends thereof and adjacent its center. Transducers are coupled to the linear ridge at opposite ends thereof adjacent the actuators that are adapted to provide signals indicative of the linear and angular displacement of the linear scanner ridge. A transducer is disposed adjacent the center linear actuator that is adapted to provide signals indicative of the amount of bending of the linear scanner ridge. A servo control system is coupled to the actuators and transducers that executes a control algorithm that processes information regarding the location, angular displacement and deflection of the linear scanner ridge and that provides correction signals to the actuators to maintain the linear scanner ridge parallel to the waveguide cavity and provide signals to the center actuator to dynamically correct for deflection of the linear scanner ridge to keep it relatively flat or straight. The active deflection compensator thus compensates for deflections of a slender body or beam (the linear scanner ridge) when it is subjected to dynamic loads. Throughout its range of motion, the oscillating beam is commanded to positions that are to be reached at specific times. The time and position commands produce accelerations on the beam that interact with its mass producing forces and deflections on the beam. The use of the center actuator provides an active response by adding (when the point lags behind) or subtracting (when the point moves ahead) to actively compensate for beam deflections.

4 Claims, 4 Drawing Sheets

ACTIVE DEFLECTION COMPENSATOR

BACKGROUND

The present invention relates generally to deflection compensation systems, and more particularly, to an active deflection compensator that compensates for deflections of a slender body or beam when it is subjected to dynamic loads.

The prior art relating to scanning radio frequency beams includes scanning by mechanically rotating an antenna array, or electronically scanning of an RF beam. One disadvantage of the rotating radar antenna array is that the radiating surface of the array must be moved around its axis of rotation. As the array moves, the body of the array and other mechanical components generate a swept volume proportional to the angle of rotation. Other objects that are within the swept volume cause interference with the array. In a rotating (oscillating) radar, its larger moving mass increases the inertia which requires more powerful motors with a consequential cost and weight increase, and larger power consumption. An electronically scanned antenna is implemented such that a radar beam is scanned by phase shifting an RF signal. The electronically scanned antenna type radar is larger, heavier, more expensive, and requires much more power than the oscillating beam type radar.

Therefore, it is an objective of the present invention to provide for an active deflection compensator that may be employed in a rotating or oscillating radar system, and which compensates for deflections of a slender body or beam that is part of the radar system when it is subjected to dynamic loads.

SUMMARY OF THE INVENTION

In order to meet the above and other objectives, the present invention is an active deflection compensator for use with an antenna system that comprises an antenna array and a linear scanner ridge that projects into a waveguide cavity that is coupled to the antenna array. The active deflection compensator comprises first and second linear actuators coupled to the linear ridge at opposite ends thereof and a third linear actuator coupled to the linear ridge adjacent its center. First and second transducers are coupled to the linear ridge at opposite ends thereof adjacent the first and second linear actuators that are adapted to provide signals indicative of the linear and angular displacement of the linear ridge scanner. A third transducer is coupled to the linear ridge adjacent third linear actuator that is adapted to provide signals indicative of the amount of bending of the linear ridge scanner. A servo control system is coupled to the actuators and transducers that executes a control algorithm to process information regarding the location, angular displacement and deflection of the linear scanner ridge and provide correction signals to the first and second actuators to maintain the linear scanner ridge parallel to the waveguide cavity and provide signals to the third actuator to dynamically correct for deflection of the linear scanner ridge to keep it relatively straight.

The present active deflection compensator is adapted to compensate for deflections of a slender body or beam (the linear scanner ridge) when it is subjected to dynamic loads. The present system employs the linear actuator (voice coil), located at or near a point of maximum deflection of the moving beam (typically its center), to compensate for deflections caused by acceleration of the beam while it travels within its range of motion. The present active compensator maintains the slender oscillating beam (located at the bottom of a radio frequency (RF) waveguide) parallel to the radiating surface of the waveguide while the oscillating beam moves towards or away from the radiating surface. The slenderness and low cross-sectional profile of the beam are dictated by the size of the cavity in the RF waveguide. Through its range of motion, the oscillating beam is commanded to positions that are to be reached at specific times. The time and position commands produce accelerations on the beam that interact with its mass producing forces and deflections on the beam.

The advantage of using a center actuator (voice coil) is that it provides an active response by adding (when the point lags behind) or subtracting (when the point moves ahead) to actively compensate for beam deflections. The present invention has a clear advantage over techniques that increase the cross-section of the beam to reduce deflections within permissible limits, because it does not increase the size or inertia of the beam or cause an increase in frictional forces.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
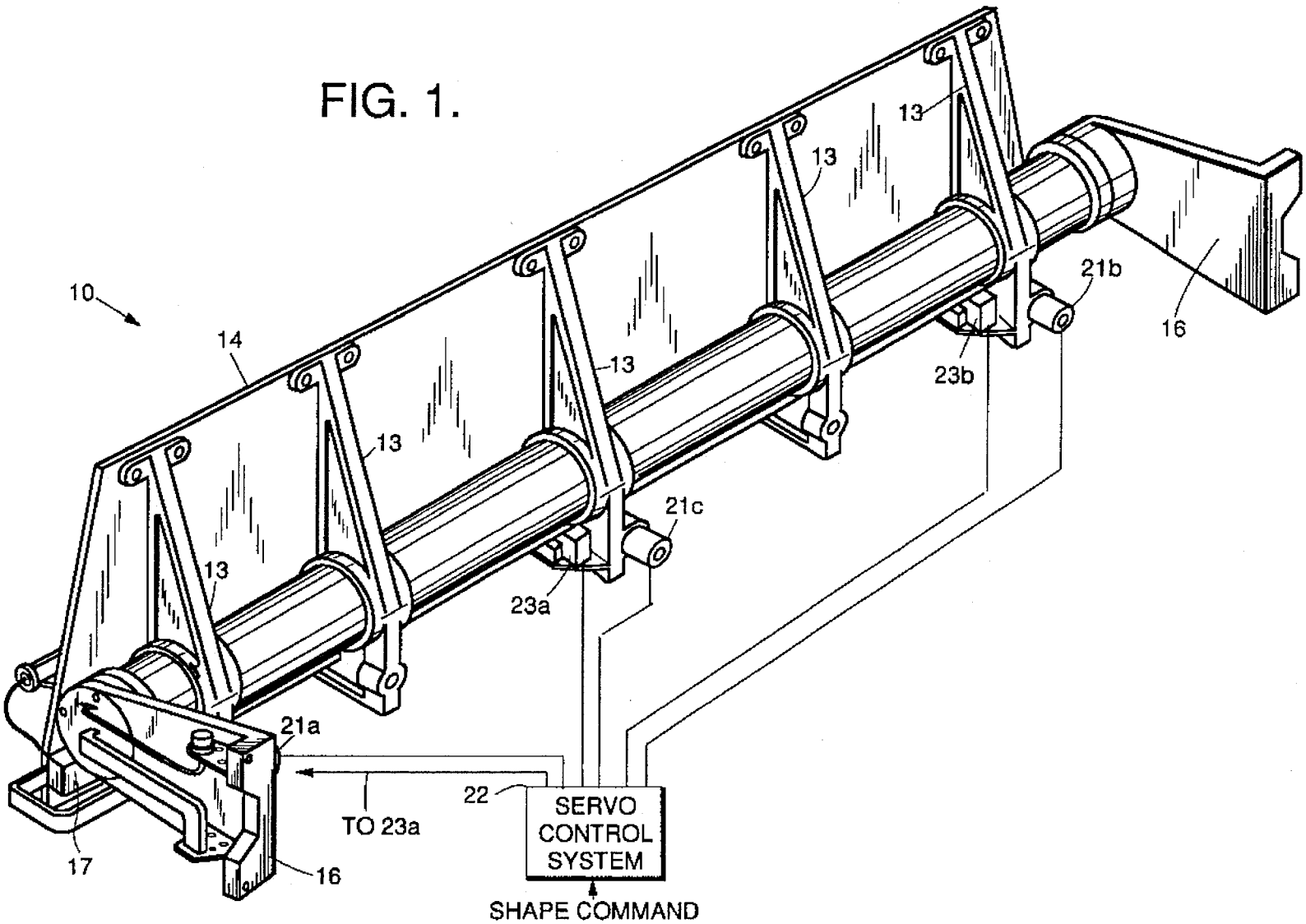
FIG. 1 is a perspective view of a radar antenna system incorporating an active deflection compensator in accordance with the principles of the present invention.

Referring to the drawing figures, FIG. 1 is a perspective view of a radar antenna system 10 incorporating an active deflection compensator in accordance with the principles of the present invention. The radar antenna system 10 is comprised of a thin wall tube 12, or torque tube 12, to which a plurality of triangular support ribs 13 are attached. An antenna array 14 is attached to the plurality of triangular support ribs 13. Attached in front of the antenna array 14 is an independent scan monitor 15 which extends along the full length of the antenna array 14. The independent scan monitor 15 is mounted to a support frame 18 by an air transformer cover 19. The scan monitor 15 monitors the output of the array 14 with a narrow receive beam and has peak outputs at predetermined angular positions in the scan and which is used to verify that the beam sweeps in azimuth. Two support brackets 16 are disposed at each end of the torque tube 12. A linear scanner ridge 17 is disposed adjacent to bottom of the antenna array 14. Three low voltage displacement transducers 21*a*, 21*b*, 21*c* (first, third and second, corresponding to left, right, and center) are disposed on selected support fibs 13 and are coupled to the linear scanner ridge 17 and to the servo system. The three low voltage displacement transducers 21*a–c* provide feedback signals to a servo control system 22 that are used as control signals that drive a corresponding plurality of linear actuators 23*a*, 23*b*, 23*c* (first, third and second, corresponding to left, right, and center), or voice coil drivers 23, that are coupled to the linear scanner ridge 17.

In the radar antenna system 10 shown in FIG. 1, the first linear actuator 23*a*, or voice coil driver 23*a* (hidden behind the left support bracket 16), is disposed at a position adjacent the leftmost support rib 13, adjacent to the leftmost support bracket 16, and the third voice coil driver 23*b*, or linear actuator 236, is attached to a support rib 13 disposed at a position adjacent the rightmost support bracket 16. The second voice coil driver 23*c*, or linear actuator 23*c*, is located adjacent the center of the array 14 and provides for active deflection compensation in accordance with the principles of the present invention. The third voice coil driver 23*b* may be attached to a support rib 13 located adjacent the center of the antenna array 14 as shown in FIG. 1. In general, the first and third voice coil drivers 23*a*, 23*b* are typically located at opposite ends of the antenna array 14 and the second voice coil driver 23*b* is near the center of the antenna array 14. The three voice coil drivers 23*a–c* and low voltage displacement transducers 21*a–c* are coupled to the servo control system 22 which controls the forces exerted by the voice coil drivers 23*a–c* on the linear scanner ridge 17 in response to feedback signals provided by the low voltage displacement transducers 21*a–c*.

Figure 2:
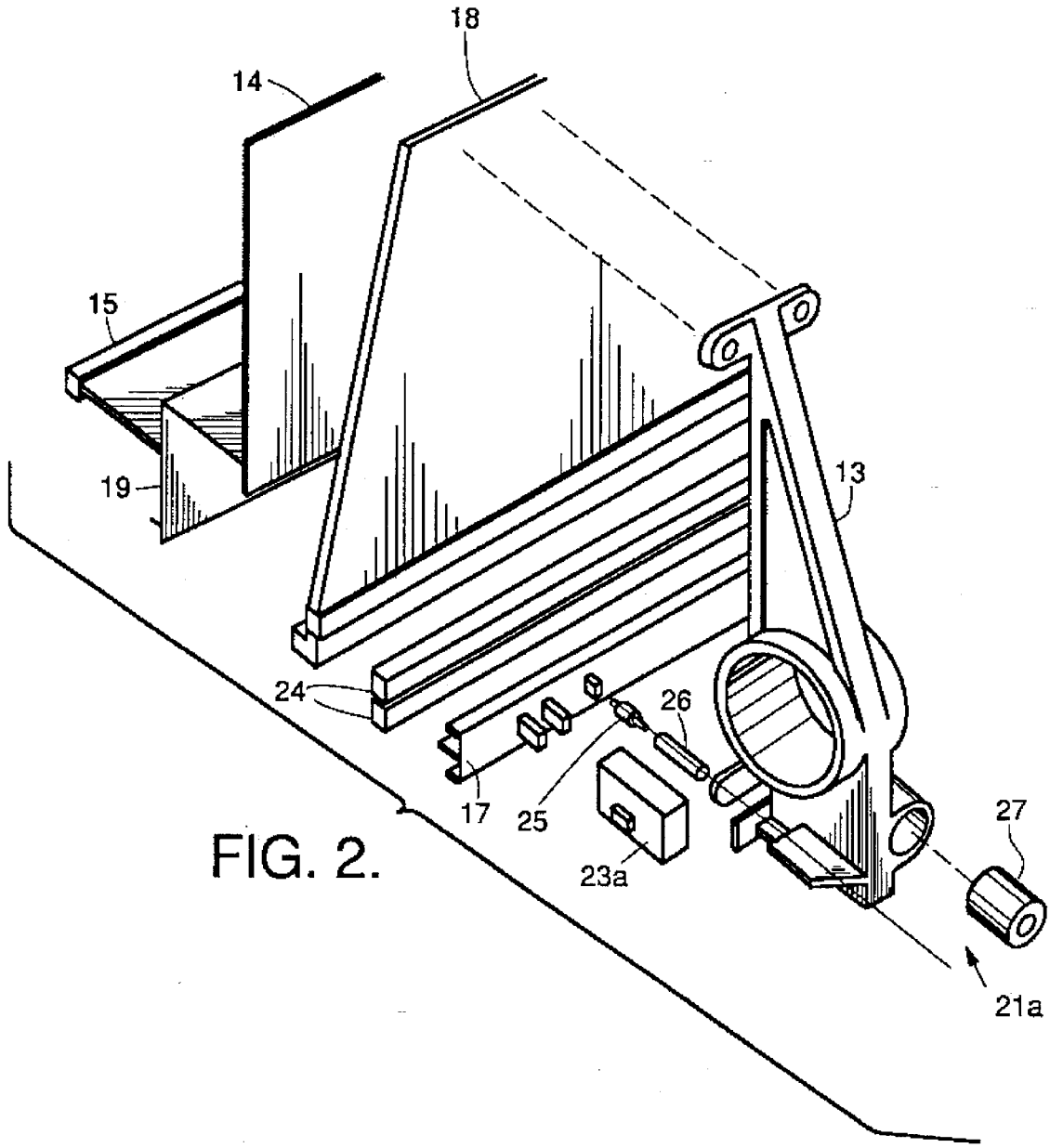
FIG. 2 is an exploded perspective view of a portion of the radar antenna system of FIG. 1.

FIG. 2 shows an exploded perspective view of a portion of the radar antenna system 10 of FIG. 1. Shown in more detail is the antenna array 14 which includes a support frame 18 that is connected to the plurality of support ribs 13. The antenna array 14 is coupled to the support frame 18 and an air transformer cover 19 is coupled to the bottom of the antenna array 14. The independent scan monitor 15 is disposed in front of the air transformer cover 19 and the antenna array 14 adjacent the bottom thereof. At the rear of the support frame 18 adjacent its bottom are disposed a plurality of choke plates 24 and the linear scanner ridge 17. The first voice coil driver 23*a* is shown coupled to the linear scanner ridge 17 along with the low voltage displacement transducer 21*a*. The low voltage displacement transducer 21*a* is comprised of a core adapter 25 that is coupled to the linear scanner ridge 17, a core 26 coupled to the core adapter 25, and a housing 27 in which the core 26 and core adapter 25 are housed. The voice coil driver 23*a* and transducer 21*a* may be secured to the linear scanner ridge 17 in any conventional manner.

Figure 3:
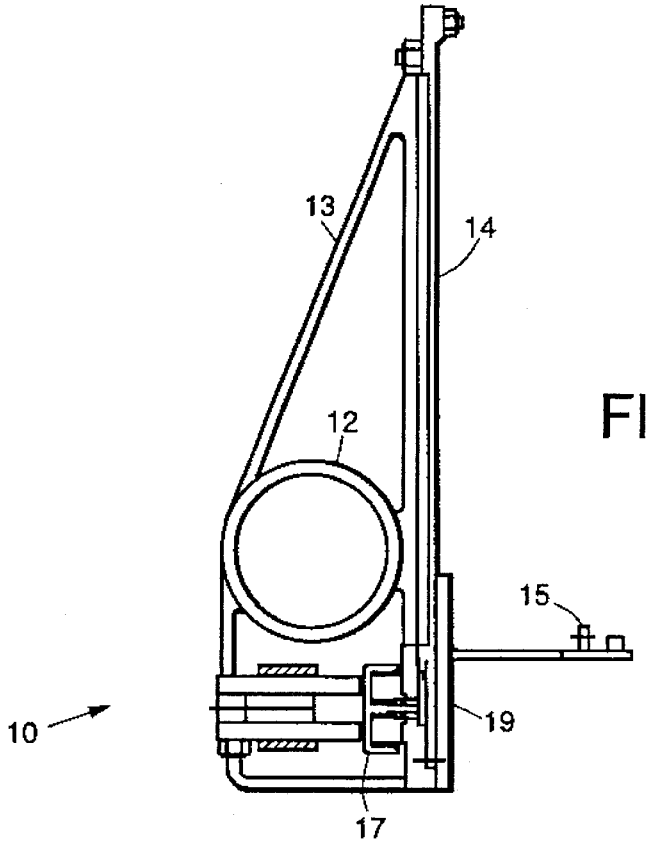
FIG. 3 shows a side view of the radar antenna system of FIG. 1.

FIG. 3 shows a side view of the radar antenna system 10 of FIG. 1. The connection of the scanner array 14 to the support ribs 13 is show more clearly, as well as the location of the independent scan monitor 15 relative to the front surface of the scanner array 14 and the linear scanner ridge 17.

Figure 4:
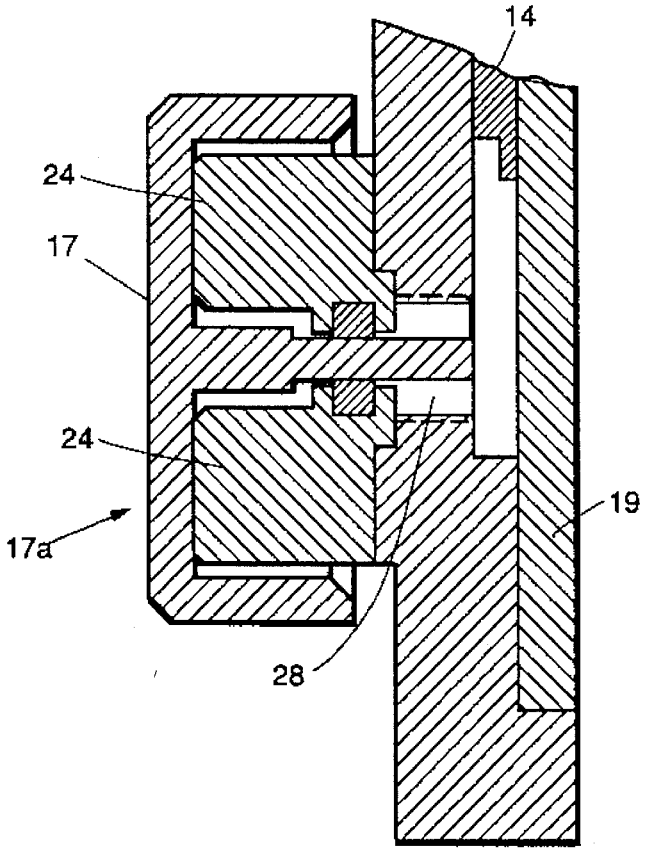
FIG. 4 shows an enlarged cross-sectional view of a line scanner ridge that is compensated by the active deflection compensator in accordance with the principles of the present invention.

FIG. 4 shows an enlarged cross-sectional view of the area of the system 10 adjacent linear scanner ridge 17 that is compensated by the active deflection compensator in accordance with the principles of the present invention. The linear scanner ridge 17 is configured as a slender beam 17*a*. The beam 17*a* is approximately 34 inches in length and has an E-shaped cross-section. The center leg of the beam 17*a* extends into a waveguide cavity 28 of the antenna array 14, and during operation moves within the waveguide cavity 28 a small amount, typically on the order of 0.75 inches. Two vertical lines (identified as "ridge position 20") identify the small distance that the linear scanner ridge 17 moves relative to the waveguide cavity 28. The linear scanner ridge 17 (E-shaped beam 17*a*) is subjected to an oscillating linear motion during operation of the radar antenna system 10. The linear scanner ridge 17 extends into the waveguide cavity 28 by a predetermined amount. The structure surrounding the waveguide cavity 28 is stationary, and the linear actuators 23 that drive the linear scanner ridge 17 are attached thereto.

Figure 5:
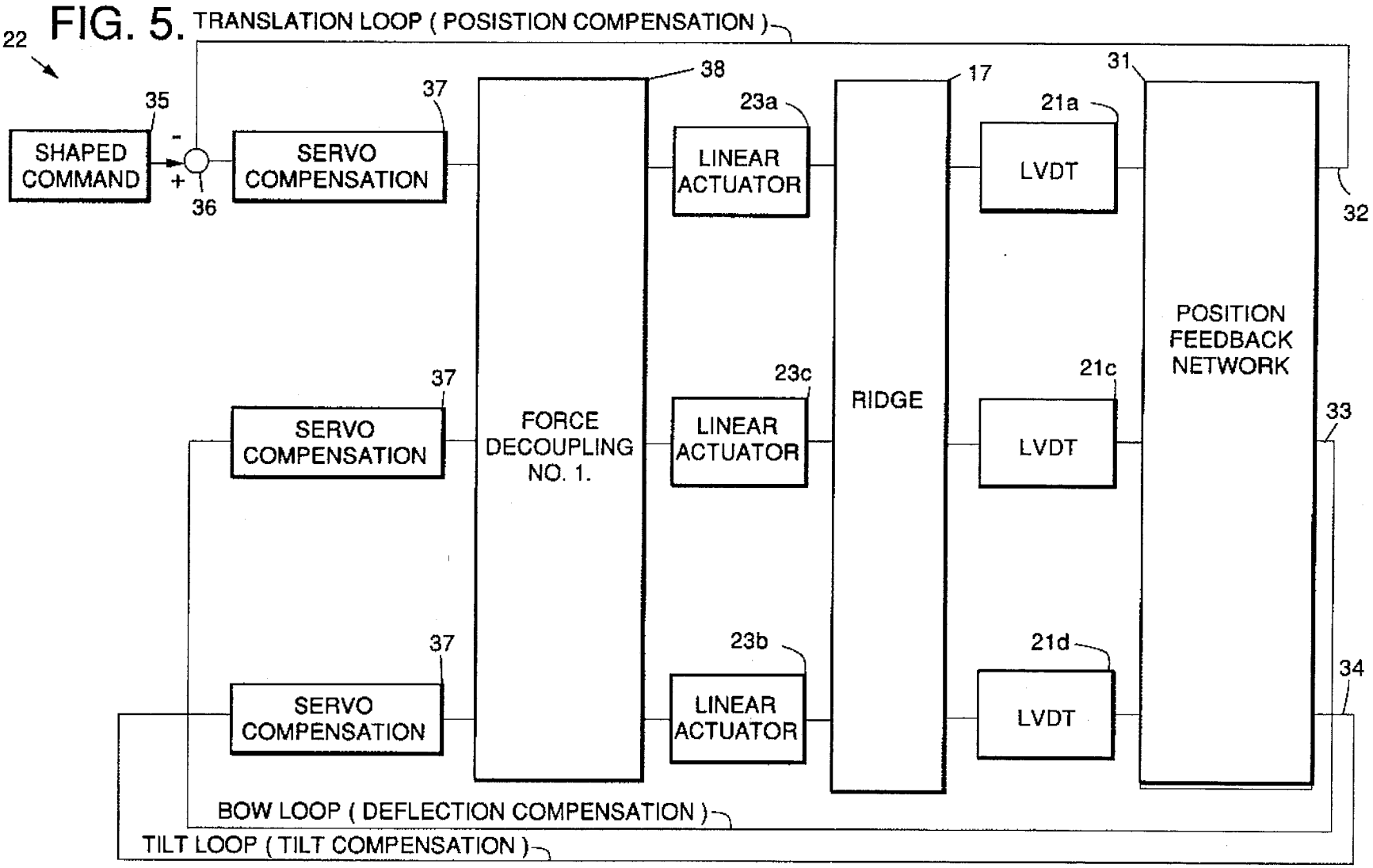
FIG. 5 is a block diagram of a servo control system employed with the active deflection compensator used in the radar antenna system of FIG. 1.

FIG. 5 is a block diagram of a servo control system 22 employed in the radar antenna system 10. The scanner ridge 17 is coupled to a position feedback network 31 of the servo control system 22 by way of the three low voltage deflection transducers 21. The signal outputs of the position feedback network 31 comprise a position compensation signal that is the average of the output signals from outer transducers 21*a*, 21*c*, a deflection compensation signal that is the difference between the output signal from the third (center) transducer 21*c* and the average of the output signals from the outer transducers 21*a*, 2l*b*, and a tilt compensation signal that is the difference between the output signals from the outer transducers 21*a*, 21*c*.

The three output signals from the position feedback network 31 are fed back by way of a translation feedback loop 32 that feeds back the position compensation signal, a bow feedback loop 33 that feeds back the deflection compensation signal, and a tilt feedback loop 34 that feeds back the tilt compensation signal. The position and tilt compensation feedback signals coupled by way of the bow and tilt feedback loops 33, 34 are applied to respective bow and tilt servo compensation circuits 37*b*, 37*c*. An external shape command 35, typically provided by an external computer (not shown), is coupled to one input of a summing device 36 that combines the shape command with the position feedback signal provided by the translation loop 32 that is applied to a second input of the summing device 36. The output of the summing device 36 comprises an error signal that is coupled to a translation servo compensation circuit 37*a*. The servo compensation circuits 37*a–c* process the translation error signal and the deflection and tilt compensation signals and produce three compensation signals that are coupled to a force decoupling network 38. Three output signals of the force decoupling network 38 are coupled to the scanning ridge 17 by way of the three linear actuators 23*a–c*.

Given the above structural details of the radar antenna system 10, the present active deflection compensator moves the linear scanner ridge 17 into and out of the waveguide cavity 28 using a selected scan pattern. The linear scanner ridge 17 has two degrees of freedom and experiences a rotation and a displacement. During scanning of the radar antenna system 10, the servo control system 22 provides correction signals to the first and second voice coil drivers 23*a*, 23*b* located at each end of the linear scanner ridge 17 to cause it to remain substantially parallel to the waveguide cavity 28. The shape of the scan pattern imposes positive and negative accelerations on the linear scanner ridge 17.

These accelerations acting on the mass of the linear scanner ridge 17 produces reactive forces that alter the flatness or straightness of the linear scanner ridge 17 due to bending. The third voice coil driver 23*b* dynamically corrects the deflection of the linear scanner ridge 17 to cause it to remain relatively flat or straight. The correction to the flatness of the linear scanner ridge 17 is carried out through commands provided by the servo control system 22 to the center voice coil driver 23*c*. The servo control system 22 executes an algorithm that processes information regarding the location and angular displacement of the linear scanner ridge 17 as well as its deflection. The first and second low voltage displacement transducers 21*a*, 21*b* located at each end of the antenna array 14 are used to measure the linear and angular displacement. The third low voltage displacement transducer 21*c* located near the center voice coil driver 23*c* is used to measure the amount of bending.

The active deflection compensator of the present invention has been designed for use in a commercial aviation radar developed by the assignee of the present invention. This radar is designed to create a real image of a runway in the cockpit during landings made in poor visibility weather. The image is created by scanning a radio frequency (RF) beam in an azimuth sweeping motion. The angular scanning of the RF beam is produced by linearly moving the oscillating beam towards and away from the radiating surface of the waveguide cavity 28.

The present active deflection compensator may be used with a radar system wherein rotating the array 14 is impossible because of its size, and interference with a radome or an aircraft bulkhead. Proper scanning of the beam is only possible if the oscillating beam remains straight and parallel to the radiating surface at all times. This is the requirement that dictates the need for an active deflection compensator of the present invention. Other applications for the present invention include any limited scanning radar, especially those designed as a landing aid in commercial aviation. In addition, the present invention may be used as a component in any poor visibility landing radar system.

Thus there has been described a new and improved active deflection compensator that compensates for deflections of a slender body (beam) when it is subjected to dynamic loads. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An active deflection compensator for use with an antenna system comprising an antenna array and a linear scanner ridge, said linear scanner ridge having a first end and a second end and a center thereof, that projects into a waveguide cavity that is coupled to the antenna array, said active deflection compensator comprising:

a first linear actuator coupled to said first end of said linear scanner ridge;

a second linear actuator coupled to said second end of said linear scanner ridge;

a third linear actuator coupled to said center of said linear scanner ridge;

a first transducer coupled to said first end of said linear scanner ridge adjacent the first linear actuator for providing signals indicative of linear and angular displacement of the linear scanner ridge;

a second transducer coupled to said second end of said linear scanner ridge adjacent the second actuator for providing signals indicative of linear and angular displacement of the linear scanner ridge;

a third transducer coupled to the linear scanner ridge adjacent the third linear actuator for providing signals indicative of amount of bending of the linear scanner ridge; and a servo control system coupled to the linear actuators and to the transducers for executing a control algorithm that processes signals indicative of the location, angular displacement and deflection of the linear scanner ridge and for providing correction signals to the first and second actuators to maintain the linear scanner ridge parallel to the waveguide cavity and to provide signals to the third actuator to dynamically correct for deflection of the linear scanner ridge to keep it relatively straight.

2. The active deflection compensator of claim 1 wherein the linear actuators each comprise voice coils.

3. The active deflection compensator of claim 1 wherein the transducers each comprise low voltage displacement transducers.

4. The active deflection compensator of claim 1 wherein the servo control system comprises:

command signal means for providing a shape command signal;

a position feedback network coupled to the scanner ridge by way of the linear actuators for producing position, deflection and tilt output signals derived from the signals produced by the actuators;

a summing device for combining the shape command signal and the position output signal to provide an error signal;

three servo compensation circuits respectively coupled to the summing device and the position feedback network for receiving the error signal from the summing device and the deflection and tilt output signals from the position feedback network and for providing three compensation signals; and a force decoupling network coupled between the three servo compensation circuits and the linear actuators.

* * * * *